US005090481A

United States Patent [19]

Pleasants et al.

[11] Patent Number: 5,090,481

[45] Date of Patent: Feb. 25, 1992

[54] FLUID FLOW CONTROL APPARATUS, SHIFTING TOOL AND METHOD FOR OIL AND GAS WELLS

[75] Inventors: Charles W. Pleasants, Carrollton; Stewart H. Fowler, Jr., Plano, both of Tex.

[73] Assignee: Otis Engineering Corporation, Dallas, Tex.

[21] Appl. No.: 653,547

[22] Filed: Feb. 11, 1991

[51] Int. Cl.[5] ..... E21B 4/14; E21B 34/12; E21B 34/14; E21B 37/00

[52] U.S. Cl. ..... 166/373; 166/50; 166/312; 166/178; 166/332; 166/384; 166/386

[58] Field of Search ..... 166/373, 332, 178, 386, 166/222, 384, 50

[56] References Cited

U.S. PATENT DOCUMENTS 3,051,243 8/1962 Grimmer et al. .
3,211,232 10/1965 Grimmer .
4,909,325 3/1990 Hopmann ..... 166/312
4,917,191 4/1990 Hopmann et al. ..... 166/381
4,928,770 5/1990 Murray ..... 166/385
4,928,772 5/1990 Hopmann ..... 166/386
4,940,094 7/1990 Lessi et al. ..... 166/373
4,967,841 11/1990 Murray ..... 166/312
4,991,654 2/1991 Brandell et al. ..... 166/334

*Primary Examiner*—Stephen J. Novosad
*Attorney, Agent, or Firm*—Warren B. Kice

[57] ABSTRACT

A fluid flow control apparatus, shifting tool and method for oil and gas wells in which a sliding sleeve valve is connected in a string of well tubing in a wellbore casing. The sliding sleeve valve functions to selectively control fluid communication between the well tubing and the wellbore casing. A shifting tool is provided for opening and closing the sliding sleeve valve and is connected to reeled tubing for receiving a fluid. The shifting tool includes a nozzle for discharging the fluid into the well tubing during or after the valve shifting operation.

20 Claims, 5 Drawing Sheets

FLUID FLOW CONTROL APPARATUS, SHIFTING TOOL AND METHOD FOR OIL AND GAS WELLS

BACKGROUND OF THE INVENTION

The present invention relates to a fluid flow control apparatus, shifting tool and method and, more particularly, to a system, tool and method for controlling the flow of fluid in oil and gas earth wells utilizing reeled tubing.

Sliding sleeve valve assemblies are frequently used to control fluid between flow conductors, such as well tubing, and underground hydrocarbon producing formations. The sliding sleeve valve assemblies may be used to allow formation fluids to flow from an underground formation into a well tubing string and then to the well surface and/or to control the flow of stimulation fluids from the well surface to the underground formation, via the well tubing.

The valve assembly includes a sliding sleeve valve which is movable between an open position for permitting the flow of the stimulation fluid or the formation fluid to and from the formulation, and a closed position for preventing this flow. Known techniques of this type employ a shifting tool connected to wireline for opening and closing the sleeve valve, and threaded tubing for selective conveying the stimulation fluid from the well surface, through the sleeve valve and to the formation. However, these shifting tools, by virtue of being connected to wireline, rely on gravity for their operation. Thus, they are inadequate in connection with highly deviated and horizontal well completions.

Reeled tubing has been used in connection with well tools of the above type since the reeled tubing does not rely on gravity but rather can traverse highly deviated, or horizontal, wells which could otherwise not be traversed with wireline in a controlled manner. Also, since the reeled tubing is continuous, it can be more rapidly inserted into the well and can be more easily passed through downhole equipment. Reeled tubing can also be used to convey fluids to the well tubing, such as water, foam, paraffin, corrosion inhibitors, spotting acid, cement, and the like, for performing various functions including washing and cleaning the well tubing.

Since stimulation techniques are often necessary in deviated, or horizontal wells, there is a need to apply the advantages of reeled tubing with shifting tools for operating sliding sleeve valve assemblies in these types of wells.

SUMMARY OF THE INVENTION

It is therefore an object of the present invention to provide an apparatus, tool and method for controlling the flow of stimulation fluid into oil and gas and production fluid from underground formations in oil and gas wells.

It is a still further object of the present invention to provide an apparatus, tool and method of the above type in which fluid communication is selectively controlled by a sliding sleeve valve assembly.

It is a still further object of the present invention to provide an apparatus, tool and method of the above type which can be used in vertical, deviated, or horizontal wells.

It is a still further object of the present invention to provide an apparatus and method of the above type which includes a shifting tool which is connected to reeled tubing.

It is a still further object of the present invention to provide an apparatus and method of the above type in which a nozzle is associated with the shifting tool for receiving fluid from the reeled tubing and discharging it into the well tubing for cleaning the well tubing and the sliding sleeve valve assembly and/or for stimulating the formation in the well.

It is a still further object of the present invention to provide a shifting tool for actuating the sliding sleeve valve assembly.

Toward the fulfillment of these and other objects, the apparatus of the present invention includes a shifting tool assembly for operating a sliding sleeve valve assembly connected in a string of well tubing which is inserted in a wellbore casing in an earth well. The shifting tool assembly engages a sliding sleeve of the valve assembly to move it between opened and closed positions to selectively control the flow of stimulation and formation fluids between the well tubing and the wellbore casing. Reeled tubing is connected to a downhole tool string including the shifting tool for supplying fluid to the shifting tool. A nozzle is mounted on the shifting tool for discharging the fluid into the well tubing for cleaning the well tubing and/or stimulating the earth well. The downhole tool string also includes a jar which operates in response to pressures of the cleaning fluid and functions to drive the shifting tool and therefore the sliding sleeve.

DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
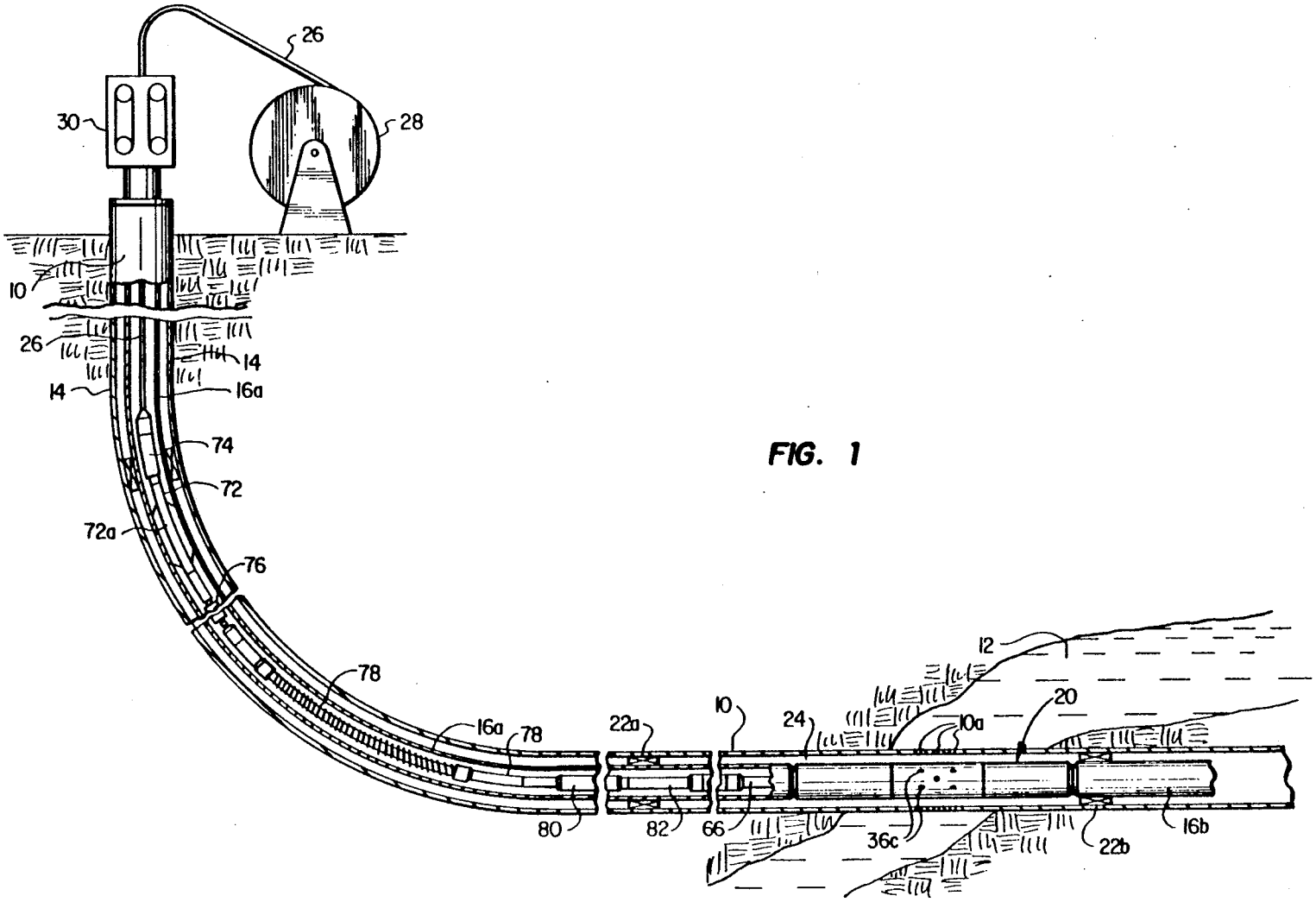
FIG. 1 is a schematic view, partially in elevation and section, and partially broken away, of an earth well, showing the apparatus of the present invention installed in a wellbore casing.

The reference numeral 10 refers to a casing passing through a formation 12 in a deviated earth well 14. A plurality of axially-spaced, radially-extending perforations 10*a* are formed through the casing 10 to discharge stimulation fluid into the formation as required and to allow formation fluids to flow into the casing 10.

The reference numerals 16*a* and 16*b* refer to an upper section and a lower section, respectively, of a string of well tubing 16 located in the casing 10. A sliding sleeve valve assembly 20 is connected between the tubing sections 16*a* and 16*b* and will be described in detail later.

Two axially-spaced packers 22*a* and 22*b* extend between the outer surfaces of the well tubing sections 16*a* and 16*b*, respectively, and the inner surface of the casing 10. The packers 22*a* and 22*b* operate in a conventional manner to anchor and seal the tubing sections 16*a* and 16*b* to the casing 10 to form a sealed annular chamber 24 and isolate the perforations 10*a* in the casing 10 from other axially-spaced perforations (not shown) formed through the casing. In this manner, stimulation fluid and production fluid can flow, via the perforations 10*a*, to and from the chamber 24.

A section of reeled tubing 26 is stored on a reel 28 above ground and is injected into the tubing 16 by an injector 30. It is understood that a manifold (not shown) is provided which includes the necessary pumps, valves, and fluid reservoirs to discharge fluid into and through the reeled tubing 26. The fluid can be of any conventional type such as a washing or cleaning fluid or a fluid for stimulating the formation 12. It is also understood that a wellhead valve (not shown) is used to control vertical access to and fluid communication with the upper well tubing section 16*a* and blowout preventers, or the like (not shown), can be installed to block fluid flow during emergency conditions. Since these components are conventional they will not be described in any further detail.

Figure 2A:
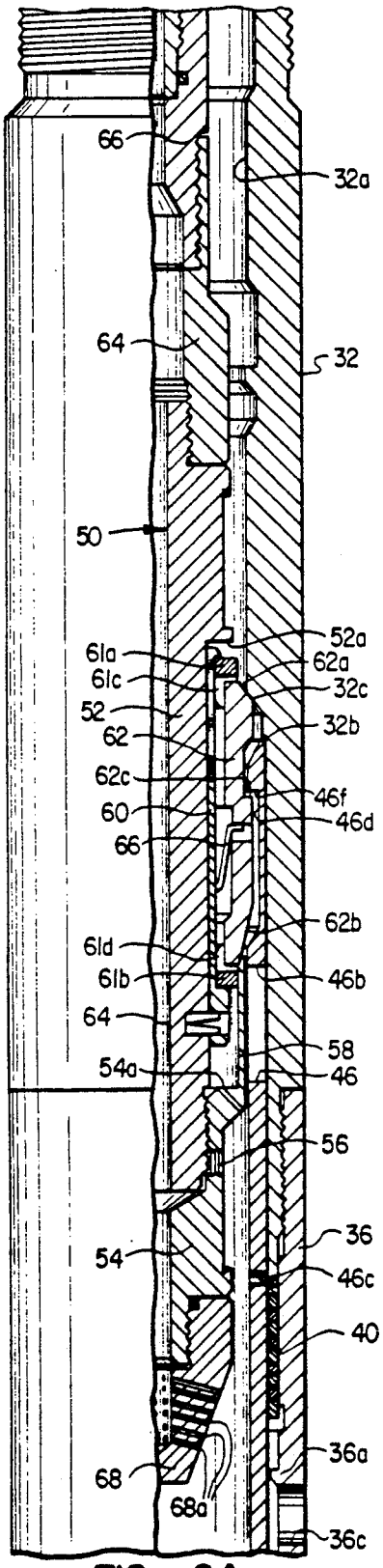
FIGS. 2A and 2B are longitudinal sectional views of the shifting tool assembly of the present invention with FIG. 2B being a downward continuation of FIG. 2A.
Figure 2B:
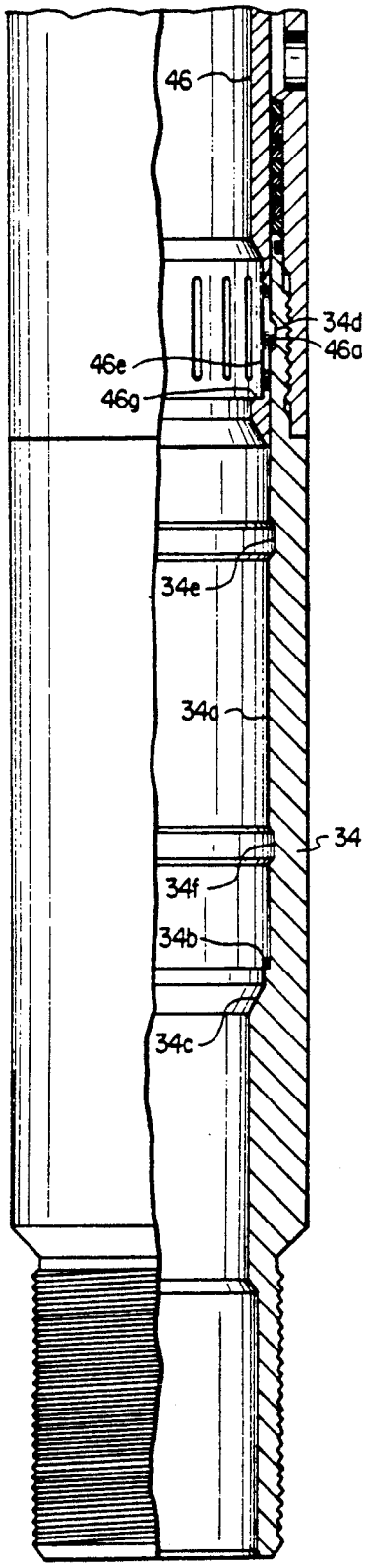
Figure 2C:
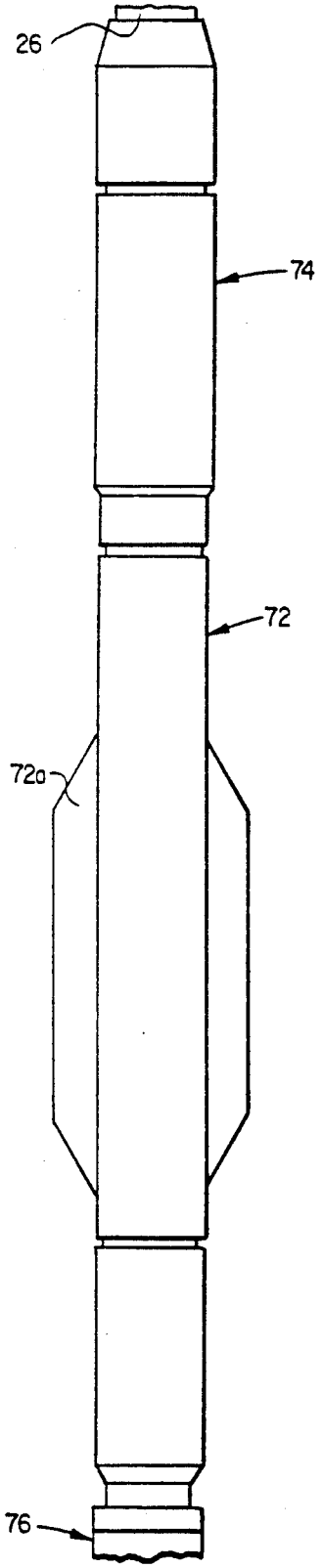
FIGS. 2C–2H are elevational views depicting a string of associated components connected between the end of a section of reeled tubing and the shifting tool assembly of FIGS. 2A and 2B, with FIG. 2D being a downward continuation of FIG. 2C, FIG. 2E being a downward continuation of FIG. 2D, FIG. 2F being a downward continuation of FIG. 2E, FIG. 2G being a downward continuation of FIG. 2F, and FIG. 2H being a downward continuation of FIGS. 2A and 2F.

Referring to FIGS. 2A and 2B, the sliding sleeve valve assembly 20 comprises an upper tubular housing 32 and a lower tubular housing 34 each of which has stepped outer diameter and inner diameters. An intermediate tubular housing 36 extends between the upper housing 32 and the lower housing 34. The upper and lower end portions of the upper housing 32 are stepped and are provided with a plurality of external threads to enable the upper end portion to be connected to the upper well tubing section 16*a* (FIG. 1) and to enable the lower end portion to receive and engage an overlapping threaded upper end portion of the intermediate housing 36. Similarly, the lower end portion of the intermediate housing 36 is in threaded engagement with the upper end portion of the lower housing 34, and the lower end portion of the latter housing is externally threaded for connection to the lower well tubing section 16*b* (FIG. 1).

An annular packing assembly 40 extends between the lower end of the upper housing 32 and an inwardly-directed annular flange 36*a* formed on the intermediate housing 36. Similarly, an annular packing assembly 42 extends between the upper end of the lower housing 34 and another inwardly-directed annular flange 36*b* formed on the intermediate housing 36 in an axially-spaced relation to the flange 36*a*. A plurality of axially-spaced and angularly-spaced openings 36*c* (only two of which are shown) are provided through the intermediate housing 36 and extend between the packing assemblies 40 and 42 in communication with the annular chamber 24 (FIG. 1). The sliding sleeve valve assembly 20 is located relative to the casing 10 so that the openings 36*c* are approximately aligned with the perforations 10*a* in the casing.

The inner bores of the upper housing 32 and the lower housing 34 are shown by the reference numerals 32*a* and 34*a*, respectively, and are stepped to define a pair of square, or perpendicular, shoulders 32*b* and 34*b*, and a pair of tapered, or beveled, shoulders 32*c*and 34*c*, respectively.

A valve sleeve 46 extends within the bore defined by the upper housing 32, the lower housing 34 and the packing assemblies 40 and 42. The outer diameter of the sleeve 46 is slightly less than the inner diameter of the latter bore to permit slidable movement of the sleeve 46 in the bore between a closed position shown in FIGS. 2A and 2B in which the upper end of the sleeve 46 engages the shoulder 32*b*, and an open position (shown and further described in connection with FIG. 3) in which the lower end of the sleeve 46 engages the shoulder 34*b*.

Three axially-spaced annular detents 34*d*, 34*e* and 34*f* are provided in the inner surface of the lower housing 34 and are adapted to be engaged by an annular raised portion 46*a* formed on the outer surface of the sleeve 46. In the closed portion of FIGS. 2A and 2B the raised portion 46*a* extends in the detent 34*d*.

A plurality of angularly-spaced openings 46*b* (one of which is shown) are provided through the valve sleeve 46 which, in the closed position of FIGS. 2A and 2B, are axially-spaced from the openings 36*c* in the intermediate housing 36. Similarly, a plurality of angularly-spaced, relatively small-diameter equalization passages 46*c* are provided through the sleeve 46 for reasons to be described. A pair of recesses, or reduced-diameter portions, 46*d* and 46*e* are provided near the respective ends of the sleeve 46 and define square annular shoulders 46*f* and 46*g*, respectively, for reasons to be described. The raised portion 46*a* of the sleeve 46 extends from the outer wall portion of the sleeve opposite the location of the recess 46*e* to permit that portion of the sleeve to flex, so that the raised portion 46*a* can move in and out of the detents 34*d*, 34*e* and 34*f*, during sliding movement of the sleeve 46 as also will be described.

The reference numeral 50 refers in general to a shifting tool of the present invention for shifting the sleeve 46 between its closed and open positions. The shifting tool 50 includes a main body member 52 which is insertable in the bore defined by the upper housing 32, the lower housing 34 and the sleeve 46. A sub member 54 is locked to one end of the body member 52 by a set screw 56 threaded in the sub member 54 and engaging a flat portion on the main body member 52. The sub member 54 is provided with an annular tubular camming sleeve 58 which extends about and is spaced from the main body member 52. The free, or upper, end portion of the sleeve 58 is beveled, for reasons to be described.

A key retainer sleeve 60 is slidably mounted on the main body member 52 for longitudinal movement relative thereto. Movement of the sleeve 60 in one direction is limited by an annular shoulder 54*a* of the sub member 54 and in the other direction by a shoulder 52*a* provided by an enlarged upper end portion of the main body member 52. A pair of retainer rings 61*a* and 61*b* are provided at the respective ends of the sleeve 60 and are secured to the sleeve by square shoulders formed at the respective ends of the sleeve 60.

A plurality of angularly-spaced key members 62 (one of which is shown in FIG. 2B) are supported by the sleeve 60 and extend between the rings 61*a* and 61*b*. The key members 62 are adapted to move radially between an expanded position shown in FIG. 2B in which they extend in the recess 46*d* (or 46*e*) of the valve sleeve 46, and a retracted position in which their inner surfaces rest against the outer surface of the sleeve 60. Each key member 62 is biased outwardly toward its expanded position by a spring 66 having one end disposed in a recess formed in the key member and the other end bearing against the sleeve 60. A pair of longitudinal lugs 61*c* and 61*d* extend from the key retainer rings 61*a* and 61*b*, respectively, and are adapted to extend into end recesses, or slots, of the key members 62 to limit the radially outward movement of the key members 62 relative to the retainer sleeve 60.

The retainer sleeve 60 is normally held in the position illustrated in FIG. 2A by means of one or more shear pins 64 extending through suitably aligned bores in the body member 52 and in an enlarged end portion of the sleeve 60. In this position the key members 62 are free to move between their expanded position illustrated in FIG. 2 and their retracted position in which their inner surfaces rest against the outer surface of the sleeve 60. The details of the key members 62, the springs 66, the retainer sleeve 60 and the packing assemblies 40 and 42 are disclosed in U.S. Pat. No. 3,051,243, assigned to the same assignee as the present invention, and the disclosure of this patent is incorporated by reference.

Each key member 62 is provided at its respective ends with beveled cam shoulders 62*a* and 62*b*, respectively which are adapted to engage obstructions, such as the shoulders 46*f* and 46*g* of the valve sleeve 46, when the shifting tool 50 is being moved through the sleeve 46, as will be described. Each key members 62 is also provided with a square shoulder 62*c* which is adapted to engage the shoulders 46*f* or 46*g* of the sleeve 46 when the key members 62 are in their expanded positions in the key recesses 46*d* or 46*e* of the sleeve 46. This engagement permits the shifting tool 50 to drive the sleeve 46 between its open and closed positions, as will be described.

The main body member 52 is provided with a reduced, externally-threaded upper end portion (as viewed in FIG. 2A) to which an internally threaded adapter sub member 64 is secured. The upper end portion of the sub member 64 is in threaded engagement with a crossover 66 which is connected to a string of tools which will be described later.

The sub member 54, which is attached to the lower end portion of the body member 52, is provided with a reduced, externally-threaded lower end portion to which an internally-threaded jet cleaning nozzle 68 is attached. The nozzle 68 has a closed lower end portion and a plurality of angularly-extending discharge passages 68*c* extending from its bore to its outer surface for discharging fluid, as will be described. The nozzle 68 may be of the type disclosed in U.S. Pat. No. 4,799,554 or U.S. Pat. No. 4,967,841, both of which are assigned to the same assignee as the present invention, and the disclosure of each is incorporated by reference.

It is a noted that continuous longitudinal internal bore is defined through the shifting tool 50 by the main body member 52, the sub members 54 and 64 and the crossover 66 which bore receives fluid from above ground for distribution to the jet cleaning nozzle 68.

FIGS. 2C–2H depict a string of tools extending above the shifting tool 50 and connected to the crossover 66. More particularly, the lower end portion of the reeled tubing 26 (FIGS. 1 and 2C) are connected to one end of a centralizer 72 by an emergency disconnect device 74 which will be described in detail later. The centralizer 72 has an enlarged portion 72*a* which closely corresponds to the inner diameter of the wellbore and thus functions to limit the tilting and bending of the reeled tubing 26 in the wellbore, and thus protect the other components below the centralizer.

One end of a pressure holding knuckle-joint 76 (FIGS. 2C and 2D) is connected to the other end of the centralizer 72 in order to enable that portion of the assembly extending below the knuckle-joint 76 to bend relatively to that portion extending above the knuckle-joint. Thus, the components in the string of FIGS. 2A–2H can more easily traverse horizontal or deviated wells.

Figure 2D:
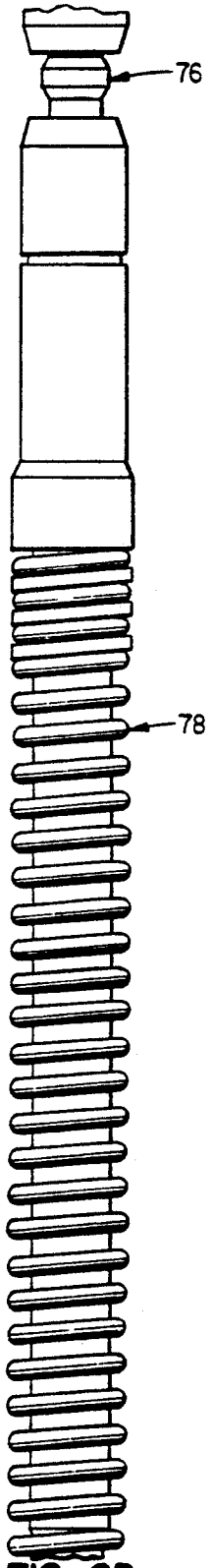
Figure 2E:
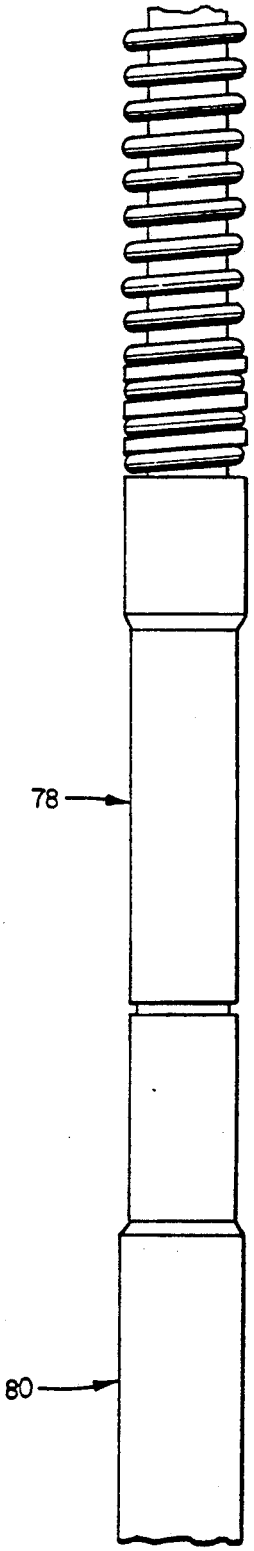

As shown in FIGS. 2D and 2E, the upper end of an accelerator 78 is connected to the lower end of the knuckle-joint 76 and functions to create spring forces to accelerate the shifting tool of the present invention to create high impact loading as will be described. Since the accelerator 78 functions in a conventional manner it will not be described in any further detail.

A weighted stem 80 (FIGS. 2E and 2F) connects the lower end of accelerator 78 to the upper end of a hydraulic jar assembly 82. The stem 80 provides the increased weight and mass necessary to create the high impact loading discussed herein.

Figure 2F:
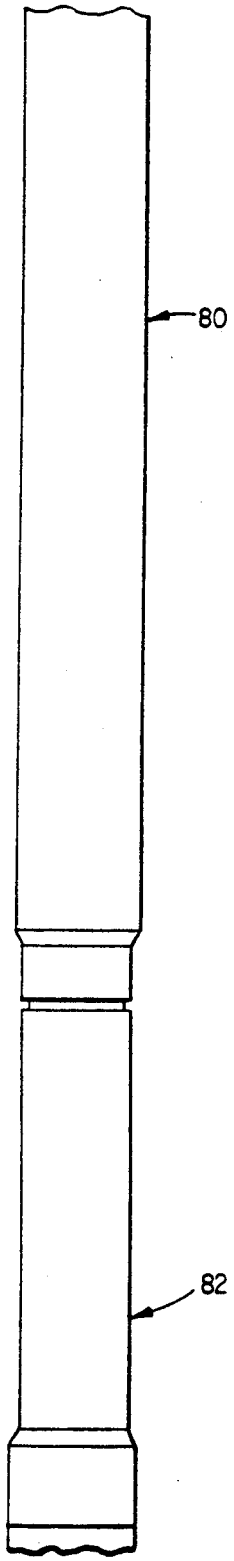
Figure 2G:
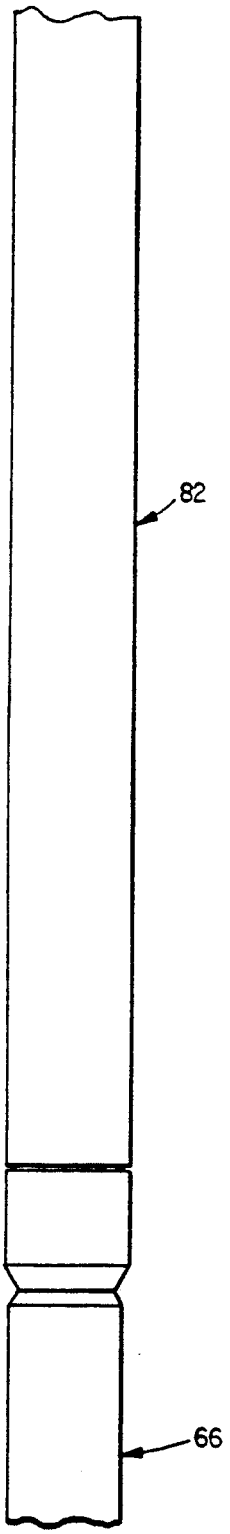
Figure 2H:
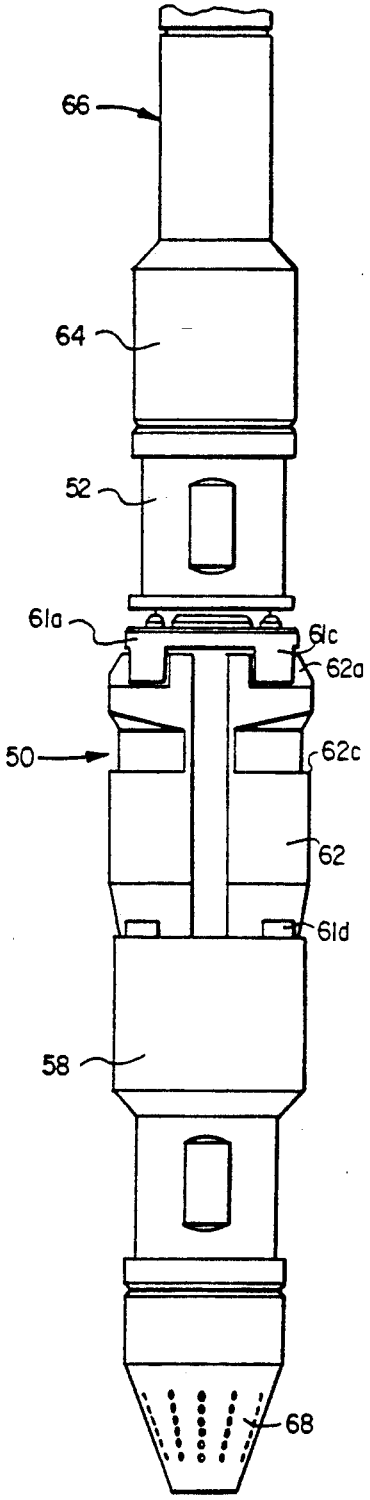

The hydraulic jar assembly 82 is shown in FIGS. 2F and 2G and operates in response to fluid pressure and functions in cooperation with the accelerator 78 and the stem 80 to provide high impact loading in both an upper and lower direction. The details of the jar assembly 82 are disclosed in U.S. patent application Ser. No. 269,996 filed Nov. 11, 1988, now abandoned and assigned to the same assignee as the present invention and the disclosure of this application is hereby incorporated by reference. The lower end of the hydraulic jar assembly 82 is connected to the upper end portion of the crossover 66 as shown in FIGS. 2G and 2H. All of the above described connections between the various components of FIGS. 2C–2H are conventional and, as such, would normally consist of a male and female tubular portions in threaded engagement.

It is understood that each of the components shown in the string of FIGS. 2C–2H have a through bore for the flow of fluid therethrough so that fluid introduced into the reeled tubing 26 above ground flows into and through the components of FIGS. 2A–2H into the nozzle 68 on the end of the shifting tool 50 for discharge. The pressure of the fluid also is utilized to operate the hydraulic jar assembly 82, as will be described.

Figure 3:
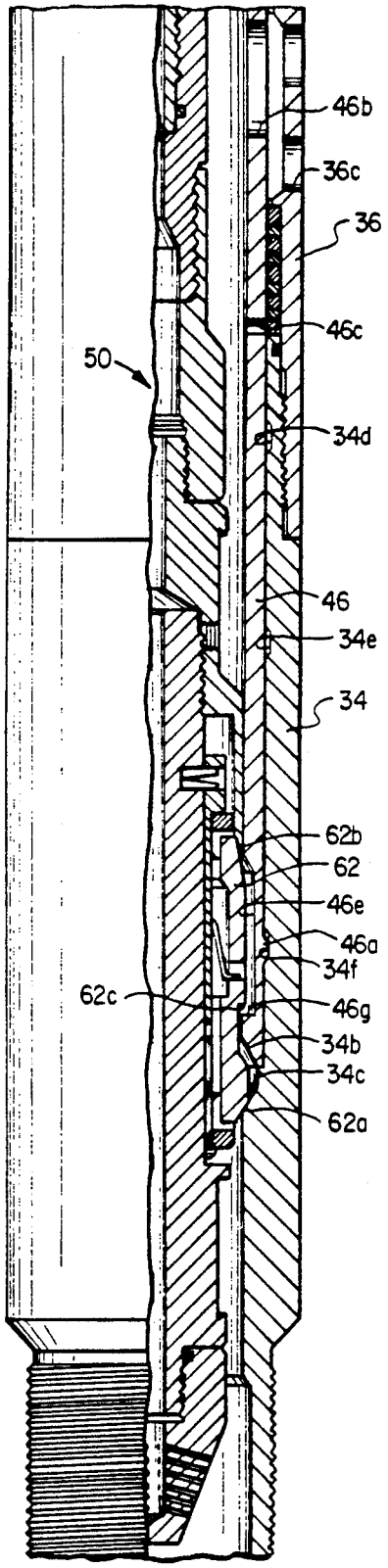
FIG. 3 is a view similar to FIG. 2A, but depicting the shifting tool assembly of FIGS. 2A and 2B in a different operating mode.

FIG. 3 depicts the valve sleeve 46 and the shifting tool 50 in a different operating position. The valve sleeve 46 is shown in its lower, open position in which its openings 46*b* align with the openings 36*c* in the intermediate housing 36 to permit the flow of stimulation fluid therethrough. The shifting tool 50 has been modified so as to engage the shoulder 46*g* of the sleeve 46 and drive the sleeve downwardly from its closed position of FIGS. 2A and 2B to its open position of FIG. 3. The modification involves removing the upper end of the body member 52 (FIG. 2A) from the sub member 64, and removing the nozzle 68 from the lower end of the sub member 54. The body member 52 (including the sub member 54, the sleeve 60 and the key members 62) is then rotated 180° about an axis perpendicular to its longitudinal axis. The sub member 54 is then connected to the sub member 64, and the nozzle 68 is connected to the lower end portion (as viewed in FIG. 3) of the body member 52. In the position of FIG. 3, the square shoulders 62c of the key members 62 are positioned to engage the square shoulder 46g of the sleeve 46 to drive the sleeve downwardly, as will be explained.

Assuming it is desired to open the valve assembly 20 by moving the valve sleeve 46 downwardly from its upper closed position of FIGS. 2A and 2B to the lower open position of FIG. 3, the shifting tool 50 is placed in the position shown in FIG. 3 in the manner described above. As the shifting tool 50 is lowered through the casing 10, cleaning and washing fluid can be introduced into the reeled tubing 26 for passage through the string of components shown in FIGS. 2C–2H and into the shifting tool assembly 50 from which it is discharged through the nozzle 68. This cleans debris, and the like which tends to accumulate in the well tubing 16 and the valve assembly 20, especially in connection with deviated earth wells 14 of the type shown in FIG. 1. During this downward movement of the shifting tool 50 through the sliding sleeve valve assembly 20, the cam shoulders 62a of the key members 62 cam the key members 62 inwardly when the key members 62 engage the inwardly extending shoulders, and the like, formed on the housings 32, 34 and 36. This movement continues until the key members 62 are aligned with, and therefore move radially outwardly into, the lower recess 46e of the valve sleeve 46 (which is in its upper position as shown in FIGS. 2A and 2B). In this position the square shoulders 62c of the key members 62 engage the square shoulder 46g of the valve sleeve 46.

The hydraulic jar assembly 82 is operated by the pressure of the cleaning and washing fluid therein as described in the above-mentioned patent application. The jar assembly 82 functions, with the accelerator 78 and the stem 80, to drive the shifting tool 50 farther downwardly to cause the value sleeve 46 to move downwardly in the valve sleeve assembly 20 from the closed position illustrated in FIGS. 2A and 2B to the open position illustrated in FIG. 3. During this movement, the raised portion 46a of the sleeve 46 flexes out of the upper recess 34d of the housing 34 and then in and out of the intermediate recess 34e before entering the lower recess 34f. In this latter position, the lower end of the sleeve 46 is in contact with the shoulder 34b, and the openings 46b in the sleeve 46 are in alignment with the openings 36c in the housing 36. Thus, well fluids from the formation 12 entering the casing 10 can flow through the aligned openings 36c and 46b, into the interior of the sleeve valve assembly 20 from which they can flow through the well tubing 16 to the ground surface. As stated above, during the downward movement of the valve sleeve 46 to its open position of FIG. 3, the equalization ports 46c in the valve sleeve 46 pass into alignment with the openings 36c in the housing 36. This permits any well fluid located outside the valve assembly 20 to pass through the aligned openings 36c and ports 46c and enter the interior of the assembly 20 to equalize the fluid pressure across the assembly before the valve sleeve 46 reaches it lower position.

As the raised portion 46a of the sleeve 46 enters the lowermost locating recess 34f as discussed above, the cam shoulders 62a of the key members 62 engage the beveled shoulder 34c of the housing 34 which cams the key members 62 radially inwardly to their retracted positions. This moves the square shoulders 62c of the key members 62 out of engagement with the shoulder 46g of the valve sleeve 46 so that the shifting tool 50 is then again free to move further downwardly, if desired, through the valve sleeve assembly 20 and the well tubing to a position below the lower packer 22b (FIG. 1).

Alternatively, after the valve sleeve 46 is moved to the lower, open position of FIG. 3, the shifting tool 50 is pulled upwardly out of the assembly 20 since the cam shoulders 62b of the key members 62 will cam the key members 62 radially inwardly doing the upward movement to retract the key members 62 and permit such upward movement of the shifting tool 50, until it is removed from the well tubing 16 The reeled tubing 26 is then disconnected from the shifting tool 50 and reinserted into the well tubing 16, and a source of stimulation fluid connected to the reeled tubing 26. The stimulation fluid thus passes through the reeled tubing 26 and discharges from the reeled tubing into the valve assembly 20 before passing through the aligned openings 46b and 36c into the chamber 24 (FIG. 1). The stimulation fluid then passes through the openings 10a in the casing and into the formation 12 for stimulating the production of oil or gas from the formation.

According to another alternative method, the fluid discharged by the nozzle 68 and normally used for cleaning can also be used for stimulation, or the fluid can be especially formulated for stimulation and not used for cleaning. In either case, after the valve sleeve 46 is moved to its open position as described above, the fluid is passed through the reeled tubing 26 and discharged from the nozzle 68 before passing through the aligned openings 46b and 36c, into the chamber 24 and through the opening 10a.

If it is desired to move the valve sleeve 46 from the lower, open position illustrated in FIG. 3 to the upper, closed position illustrated in FIGS. 2A and 2B, the shifting tool 50 is converted to the form shown in FIGS. 2A and 2B by disconnecting and rotating the main body member 52 as described above. The shifting tool 50 is then lowered through the sleeve valve assembly 20 and fluid can be introduced into the tool in the manner described above for discharge through the nozzle 68 for cleaning and washing. During this movement, the cam shoulders 62b of the key members 62 cam the key members 62 radially inwardly toward their retracted positions upon engaging all inwardly directed obstructions until the key members 62 expand radially outwardly into the upper recess 46d (FIG. 2A) of the valve sleeve 46.

An upward pull on the reeled tubing 26 causes the shoulders 62c of the key members 62 to engage the shoulder 46f of the valve sleeve 46 so that a further upward force applied to the shifting tool by the hydraulic jar assembly 82 will cause the valve sleeve 46 to move upwardly. This upward movement forces the raised portion 46a out of the lower recess 34f of the housing 34 and in and out of the intermediate recess 34e to permit movement of the valve sleeve 46 to its uppermost, closed position with the raised sleeve portion 46a engaging the upper recess 34d. In this position, the flow passages 46b of the valve sleeve 46 are out of registry with the passages 36c of the housing 36 to prevent any flow of fluids therethrough.

Referring again to FIGS. 2A and 2B, as the valve sleeve 46 moves towards its uppermost, closed position in which its upper end engages the shoulder 32b of the upper housing member 32, the cam shoulders 62a of the keys members 62 engage the beveled shoulder 32c of the upper housing member 32 to move the key members into their retracted position so that the shifting tool 50 can be pulled out of the valve assembly 20.

Should the valve sleeve 46 become lodged, or stuck, in the valve assembly 20 while it is being moved from its lower, open position to its upper, closed position, of the housing 32, upward movement of the shifting tool 50 relative to the valve sleeve 46 is prevented due to the engagement of the shoulders 62*b* of the key members 62 with the shoulder 46*f* of the valve sleeve 46. If this occurs, the accelerator 78 and the hydraulic jar assembly 82 are actuated to impart an upward force to the shifting tool 50 to cause the shear pin 64 (FIG. 2A) to shear, whereupon the beveled end portion of the camming sleeve 58 engages the cam shoulders 62*c* of the key members 62 as the body member 52 moves upwardly relative to the key retainer sleeve 60 and therefore to the key members 62. During this upward movement, the beveled end portion of sleeve 58 cams the shoulders 62*c* of the key members 62 radially inwardly to cause the key members 62 to move to their retracted position to disengage the shoulders 62*c* and 46*f* thereby freeing the shifting tool 50 for upward movement through the valve assembly 20.

Figure 4:
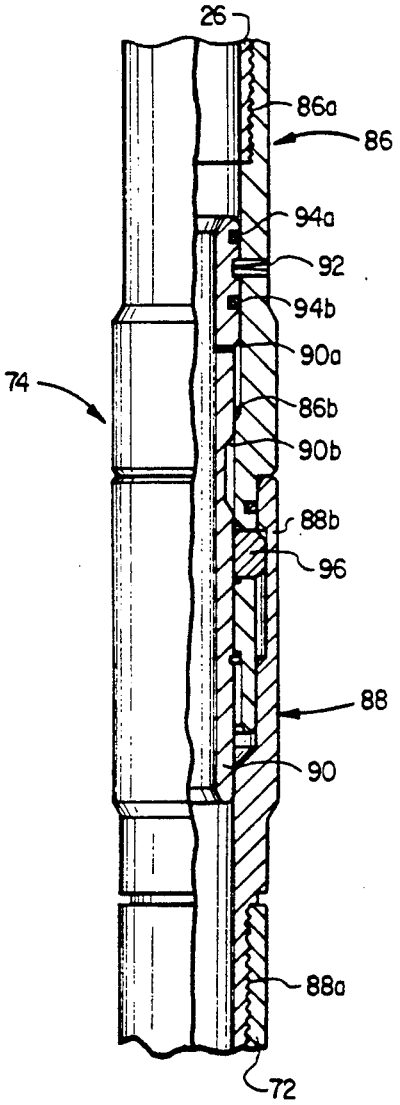
FIG. 4 is a cross-sectional view of the emergency release device of FIG. 2.

The emergency disconnect device 74, which is connected between the reeled tubing 26 and the centralizer 72, is shown in detail in FIG. 4. The disconnect device 74 comprises a top sub 86 having an internally threaded portion 86*a* for connecting to the reeled tubing 26, and a bottom sub 88 having an externally threaded portion 88*a* disposed at one end for connecting to the centralizer 72 and a fishneck 88*b* at its other end.

The bottom sub 88 is aligned with the top sub 86 in a coaxial relationship and a tubular prop 90 is disposed in the bore defined by the aligned bores of the top sub and the bottom sub in engagement therewith.

A plurality of angularly spaced shear pins 92, one of which is shown in FIG. 4, extend through radially-extending through openings in the top sub 86 and into an aligned groove in the prop 90. Two seal rings 94*a* and 94*b* extend in grooves in the prop 90 located above and below the shear pins 92, respectively. The internal bore of the top sub 86 and the external surface of the prop 90 are stepped to form two spaced shoulders 86*b* and 90*a*, respectively, and an enlarged groove 90*b* is formed in the outer surface of the prop 90 just below the shoulder 86*b*.

A plurality of angularly-spared lugs 96, one of which is shown in FIG. 4, are provided through corresponding openings in the top sub 86. One end of each lug 96 extends flush with the bore of the top sub 86 and the other end portion projects outwardly from its opening in engagement with the internal shoulder of the fishneck 88*b* of the bottom sub 88 to retain the bottom sub in the position shown.

In the event it is desired to activate the device 74 when, for example, any of the tools previously described become jammed in the wellbore, a ball (not shown) of a diameter slightly less than the bore of the top sub 86 can be pumped through the reeled tubing 26 and into the top sub where it engages the upper end of the prop 90. This seals off the prop 90, allows pressure to build up above the ball and forces the prop downwardly until the pins 92 shear. This, in turn, allows the prop 90 to move downwardly relative to the top sub 86 and the bottom sub 88 until the shoulder 90*a* engages the shoulder 86*b*. In this position, the groove 90*b* aligns with the lugs 96 which allows the lugs to move into the groove, thus releasing the top sub 86 and the prop 90 from the bottom sub 88 and permitting a quick disconnect from the shifting tool 50.

The reeled tubing 26 can then be pulled out of wellbore, taking the top sub 86 and the prop 90 with it and leaving the bottom sub 88 including the exposed fishneck 88*b*. A pulling tool, or the like, could then be inserted into the wellbore to engage the fishneck 88*b* for the purpose of releasing the jammed tool.

It is thus seen that the apparatus, shifting tool and method of the present invention provide an efficient and reliable technique for controlling fluid communication utilizing a shifting tool connected to reeled tubing and adapted to discharge cleaning or washing fluid during its operation and/or stimulation fluid after opening the valve sleeve. Also the shifting tool 50 can be used in connection with deviated or horizontal wells while performing these functions.

Modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. Apparatus for controlling fluid communication between a string of well tubing and an earth well, said apparatus comprising:

a. a sliding sleeve valve assembly comprising:
   (1) a tubular housing having a radial opening extending therethrough;
   (2) means for connecting said tubular housing to said string of well tubing; and
   (3) a valve sleeve extending within said housing and having a radial opening extending therethrough, said sleeve being slidable relative to said housing to and from an open position in which said openings align to permit fluid communication with said tubular housing;

b. a section of reeled tubing connected to a source of fluid; and c. a shifting tool assembly comprising:
   (1) a tubular body member having a longitudinal bore extending therethrough;
   (2) means for connecting said body member to said reeled tubing for inserting said body member into said valve sleeve and for introducing fluid to said bore of said body member;
   (3) means supported by said body member for engaging said valve sleeve to slide said valve sleeve to and from said open position; and
   (4) means associated with said body member for discharging said fluid into said well tubing.

2. The apparatus of claim 1 wherein said engaging means is supported by said body member in a first position for sliding said valve sleeve to said open position and a second position for sliding said valve sleeve from said open position.

3. The apparatus of claim 1 wherein said means for connecting said body member to said reeled tubing comprises jar means for receiving said fluid, said jar means operating in response to a predetermined pressure of said fluid and applying a force to said body member to slide said valve sleeve.

4. The apparatus of claim 1 further comprising two axially-spaced sealing assemblies supported on said housing and extending between, and in sealing engagement with, the inner surface of said housing and the outer surface of said valve sleeve, said opening in said valve sleeve extending between said sealing assemblies.

5. The apparatus of claim 1 wherein said housing has an enlarged bore for receiving said valve sleeve.

6. The apparatus of claim 1 wherein said valve sleeve is slidable from said open position to a closed position for blocking the flow of well fluid through said openings.

7. The apparatus of claim 1 further comprises equalizing valve means associated with said valve sleeve for selectively permitting or preventing well fluid to flow into said tubular housing.

8. The apparatus of claim 1 where said engaging means comprises at least one key mounted on said body member of said shifting tool assembly, at least one recess formed in said valve sleeve, and means for urging said key into said recess.

9. The apparatus of claim 1 wherein said means for connecting said body member to said reeled tubing comprises fluid pressure responsive means for disconnecting said body member from said reeled tubing in said well tubing.

10. A shifting tool assembly for shifting a valve sleeve in well tubing, said assembly comprising:

a. a tubular body member having a longitudinal bore extending therethrough;

b. means for connecting said body member to reeled tubing for inserting said body member into said valve sleeve and for introducing fluid from said reeled tubing to said bore of said body member;

c. means supported on said body member for engaging said valve sleeve to slide said valve sleeve to and from an open position in said well tubing to control the flow of operating fluid through said well tubing; and d. means associated with said body member for discharging said fluid into said well tubing.

11. The apparatus of claim 10 wherein said engaging means is supported by said body member in a first position for sliding said valve sleeve to said open position and a second position for sliding said valve sleeve from said open position.

12. The shifting tool assembly of claim 10 wherein said means for connecting said body member to said reeled tubing comprises jar means for receiving said cleaning fluid, said jar assembly including means responsive to a predetermined pressure of said fluid and operating in response to pressures of said fluid.

13. The shifting tool assembly of claim 10 where said engaging means comprises at least one key mounted on said body member of said shifting tool assembly, and means for urging said key into a recess in said valve sleeve.

14. The shifting tool assembly of claim 10 wherein said means for connecting said body member to said reeled tubing comprises fluid pressure responsive means for disconnecting said body member from said reeled tubing in said well tubing.

15. A method of controlling fluid communication between an earth well and a string of well tubing with a sliding sleeve valve disposed therein, said method comprising the steps of:

a. connecting a shifting tool to a section of reeled tubing for inserting at least a portion of said shifting tool into said sleeve valve;

b. introducing fluid from said reeled tubing to said shifting tool;

c. discharging said fluid from said shifting tool into said well tubing; and d. engaging said sleeve valve with said shifting tool to slide said sleeve valve to and from an open position permitting said fluid communication.

16. The method of claim 15 further comprising the step of connecting a hydraulic jar assembly between said reeled tubing and said shifting tool, said hydraulic jar assembly receiving said cleaning fluid and operating in response to a predetermined pressure of said cleaning fluid, said jar means applying a force to said shifting tool for sliding said valve sleeve.

17. The method of claim 15 wherein said step of discharging is before said step of engaging and said fluid is used for cleaning said well tubing and said valve.

18. The method of claim 15 wherein said step of engaging is before said step of discharging and said fluid is used for stimulating said earth well.

19. The method of claim 15 further comprising the step of introducing stimulation fluid through said sleeve valve in its open position for passage to said earth well.

20. The method of claim 19 wherein said step of introducing comprises the steps of removing said reeled tubing and said shifting tool from said sleeve valve, disconnecting one end of said reeled tubing from said shifting tool, connecting the other end of said reeled tubing to a source of said stimulation fluid, and reinserting said reeled tubing into said sleeve valve.

* * * * *